US006821088B2

(12) United States Patent
Sakai et al.

(10) Patent No.: US 6,821,088 B2
(45) Date of Patent: Nov. 23, 2004

(54) CENTRIFUGAL BLOWER HAVING NOISE-REDUCTION STRUCTURE

(75) Inventors: Masaharu Sakai, Kariya (JP); Kouji Matsunaga, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/097,231

(22) Filed: Mar. 13, 2002

(65) Prior Publication Data

US 2002/0131861 A1 Sep. 19, 2002

(30) Foreign Application Priority Data

Mar. 16, 2001 (JP) ..... 2001-076959
Jan. 18, 2002 (JP) ..... 2002-010324

(51) Int. Cl.[7] ..... F04D 29/42

(52) U.S. Cl. ..... 415/204; 415/119; 415/206; 415/211.1

(58) Field of Search ..... 415/119, 203, 415/204, 206, 211.1, 212.1

(56) References Cited

U.S. PATENT DOCUMENTS 4,549,848 A * 10/1985 Wallman ..... 415/206
5,352,089 A 10/1994 Tokunaga et al.
6,200,093 B1 * 3/2001 Lee et al. ..... 415/204
6,254,336 B1 * 7/2001 Ahn ..... 415/119

FOREIGN PATENT DOCUMENTS

| | | | |
|---|---|---|---|
| GB | 1051 A * | of 1885 | 415/119 |
| JP | U-50-82706 | 12/1973 | |
| JP | U-54-97805 | 12/1977 | |
| JP | U-64-11399 | 1/1989 | |
| JP | U-64-12097 | 1/1989 | |
| JP | 64-87900 A * | 3/1989 | 415/211.1 |
| JP | 1-100399 A * | 4/1989 | 415/211.1 |

* cited by examiner

*Primary Examiner*—Christopher Verdier
(74) *Attorney, Agent, or Firm*—Harness, Dickey & Pierce, PLC

(57) ABSTRACT

In a predetermined range from a nose portion toward a scroll finish side in a scroll casing of a centrifugal blower, a first clearance dimension on a side of a suction port between an outer periphery of a centrifugal fan and a side plate of the scroll casing is set smaller than a second clearance dimension on a side opposite to the suction port between the outer periphery of the centrifugal fan and the side plate of the scroll casing. In addition, in the vicinity of the nose portion, a first wall part of the scroll casing on the side of the suction port protrudes toward a scroll finish side, from a second wall part of the scroll casing on the side opposite to the suction port.

6 Claims, 7 Drawing Sheets

CENTRIFUGAL BLOWER HAVING NOISE-REDUCTION STRUCTURE

CROSS-REFERENCE TO RELATED APPLICATION

This application is claims foreign priority based upon Japanese Patent Applications No. 2001-76959 filed on Mar. 16, 2001, and No. 2002-10324 filed on Jan. 18, 2002, the contents of which are hereby incorporated by reference.

BACKGROUND OF THE INVENTION

1. Field of the Invention

The present invention relates to a centrifugal blower including a centrifugal multi-blade fan having plural blades arranged around a rotation axis. More particularly, the present invention relates to a noise-reduction structure for reducing noise caused in the centrifugal blower. The present invention is suitably used for a blower of a vehicle air conditioner.

2. Description of Related Art

In a conventional centrifugal blower described in JP-U-50-82706 or in JP-U-54-97805, a nose cap at a side of a suction port is made smaller than a nose cap at a side opposite to the suction port, so that a NZ noise is reduced while it can prevent an air-blowing amount from being reduced and a specific noise from being increased. Here, the NZ noise is a noise caused when air blown from a centrifugal multi-blade fan collides with a nose portion of a scroll casing. However, in this case, because the nose cap at the side of the suction port is made smaller than the nose cap at the opposite side of the suction port, a radial dimension of the scroll casing on the opposite side of the suction port needs to be increased for enlarging a passage-section area.

In addition, when a dimension (i.e., scroll radius) between a rotation axis of the centrifugal multi-blade fan and the scroll casing is simply set to become larger from a scroll start portion toward a scroll finish portion of the scroll casing, a low-frequency noise may be caused.

SUMMARY OF THE INVENTION

In view of the foregoing problems, it is an object of the present invention to provide a centrifugal blower which reduces low-frequency noise while specific noise is reduced.

According to the present invention, in a centrifugal blower, a centrifugal fan is disposed in a scroll casing to have a space between the centrifugal fan and the scroll casing at a nose portion, through which a scroll start side and a scroll finish side communicate with each other in the scroll case. The scroll case has an end in the vicinity of the nose portion, at a reverse side with a rotation direction of the centrifugal fan. In addition, the end is tilted relative to a direction parallel to the rotation axis, toward the rotation direction, from a side of the suction port to a side opposite to the suction port. Accordingly, a re-circulation air flow from an air outlet side (scroll finish side) into the space between the outer periphery of the centrifugal fan and the inner wall of the scroll case in the nose portion, can be introduced toward a downstream air-blowing side of the centrifugal fan with the air blown by the centrifugal fan, without being reversely introduced between blades of the centrifugal fan. Thus, it can restrict an interference between the re-circulation flowing air and the sucked air, and thereby reducing the low-frequency noise.

Alternatively, in the present invention, the scroll case has a first wall part on the side of the suction port, and a second wall part on the side opposite to the suction port, in the vicinity of the nose portion. In addition, the first wall part is disposed to protrude from the second wall part toward a reverse side with the rotation direction. Even in this case, the same advantage described above can be obtained.

Preferably, in a predetermined range from the nose portion in the rotation direction, a first clearance dimension between an outer periphery of the centrifugal fan and an inner wall of the scroll casing on the side of the suction port, is smaller than a second clearance dimension between the outer periphery of the centrifugal fan and the inner wall of the scroll casing on the side opposite to the suction port. In this case, the NZ noise and the specific noise can be further reduced while the low-frequency noise can be reduced.

Preferably, a scroll angle of the scroll casing is continuously changed in such a manner that the first clearance dimension is equal to the second clearance dimension in a range of the scroll angle between 20 degrees and 135 degrees. Therefore, noise generated in the blower can be effectively reduced. Further, in the nose portion, a ratio of the second clearance dimension to an outer diameter of the centrifugal fan is in a range of 0.1–0.16. In this case, the low-frequency noise, the NZ noise and the specific noise can be readily reduced.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PRESENTLY PREFERRED EMBODIMENT

A preferred embodiment of the present invention will be described hereinafter with reference to the accompanying drawings. In this embodiment, a centrifugal blower 7 according to the present invention is typically used for an air conditioner 1 for a vehicle having a water-cooled engine.

Figure 1:
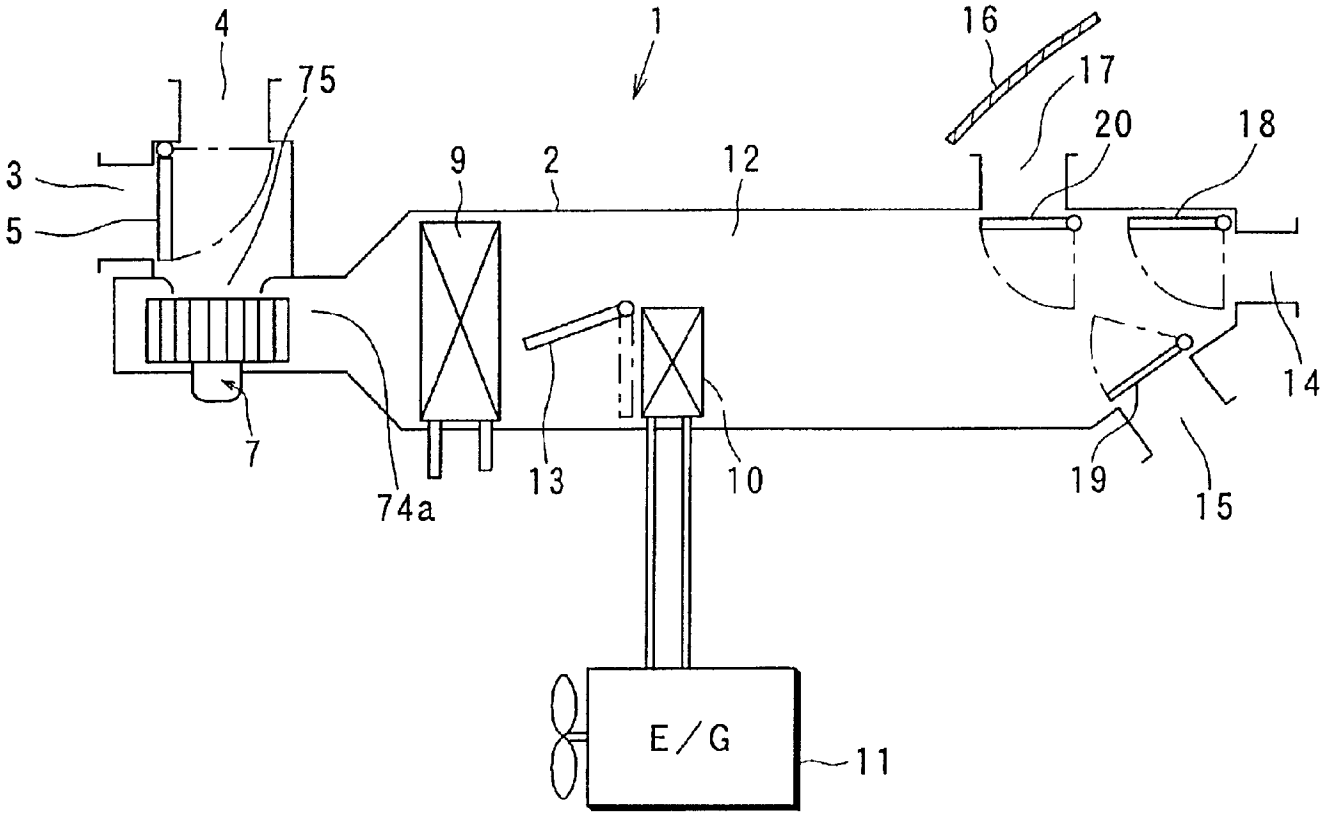
FIG. 1 is a schematic diagram showing a vehicle air conditioner using a centrifugal blower according to a preferred embodiment of the present invention.

The air conditioner 1 shown in FIG. 1 includes an air-conditioning case 2 defining an air passage through which air flows into a passenger compartment. At an upstream air side of the air-conditioning case 2, an inside air introduction port 3, through which inside air inside the passenger compartment is introduced, and an outside air introduction port 4, through which outside air outside the passenger compartment is introduced, are provided. An inside/outside air switching door 5 is disposed for selectively opening and closing the inside air introduction port 3 and the outside air introduction port 4. The inside/outside air switching door 5 can be opened and closed by using a driving unit such as a servomotor, or can be manually opened and closed.

The centrifugal blower 7 according to the present invention is disposed at a downstream air side of the inside/outside air switching door 5, so that air introduced from the inside air introduction port 3 and the outside air introduction port 4 is blown by the blower 7 toward air outlets 14, 15, 17. An evaporator 9 for cooling air passing therethrough is disposed in the air-conditioning case 2 at a downstream air side of the blower 7, so that all air blown by the blower 7 passes through the evaporator 9.

A heater core 10 for heating air passing therethrough is disposed at a downstream air side of the evaporator 9. The heater core 10 heats air using cooling water of an engine 11 as a heating source. The heater core 10 is disposed in the air conditioning case 2 to form a bypass passage 12 through which air from the evaporator 9 bypasses the heater core 10. An air mixing door 13 is disposed at an upstream air side of the heater core 10 to adjust a ratio between an air amount passing through the heater core 10 and an air amount passing through the bypass passage 12, so that the temperature of air blown into the passenger compartment is adjusted.

The air outlets from which conditioned air is blown into the passenger compartment are provided at downstream air side positions of the air conditioning case 2. The air outlets include a face air outlet 14 for blowing conditioned air toward the upper side of a passenger in the passenger compartment, a foot air outlet 15 for blowing conditioned air toward the foot area of the passenger in the passenger compartment, and a defroster air outlet 17 for blowing conditioned air toward an inner surface of a front windshield of the vehicle. Mode switching doors 18, 19, 20 are disposed at upstream air sides of the air outlets 14, 15, 17, respectively, to open and close the air outlets 14, 15, 17. The mode switching doors 18, 19, 20 can be operated by a driving unit such as a servomotor, or can be manually operated. Actually, each of the foot air outlet 15 and the defroster air outlet 17 is made smaller than the face air outlet 14, Therefore, generally, air-flowing resistance (pressure loss) in each of a foot mode and a defroster mode becomes larger than that in a face mode.

Figure 2:
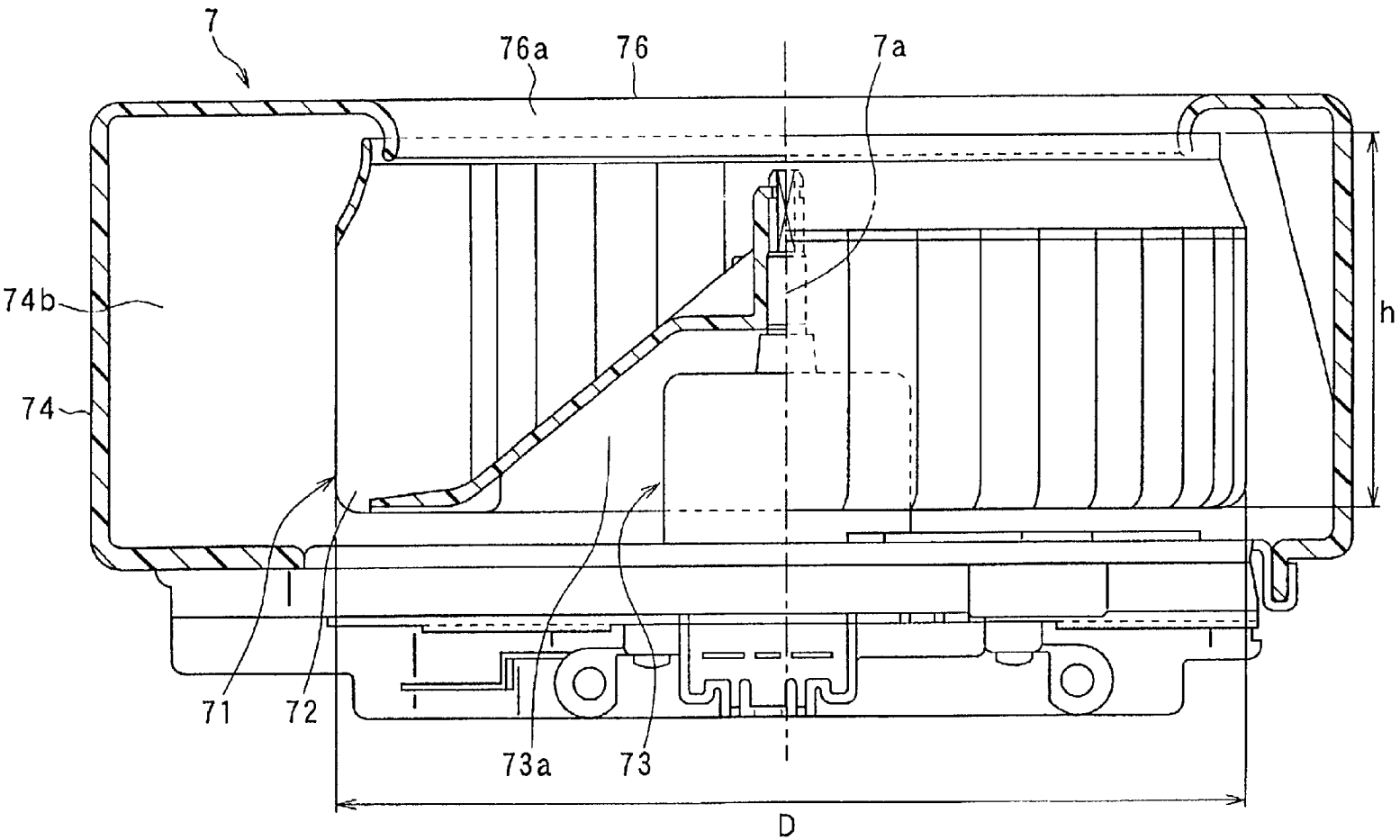
FIG. 2 is schematic sectional view showing a centrifugal blower according to the preferred embodiment.

Next, the structure of the centrifugal blower 7 according to the present embodiment will be now described with reference to FIGS. 2 and 3A–3B. The blower 7 includes a centrifugal multi-blade fan 71 having plural blades 72 arranged around a rotation axis 7*a* of the fan 71. The fan 71 is disposed, so that air is sucked from the face side of the rotation axis in FIG. 3A (from upper side in FIG. 2) and is blown radial outside. The fan 71 is disposed within a scroll casing 74, and is driven by an electrical motor 73 fixed to the scroll casing 74. The motor 73 is disposed in a motor arrangement space 73*a* on a side opposite to a suction port 76 from which air is sucked.

Figure 3A:
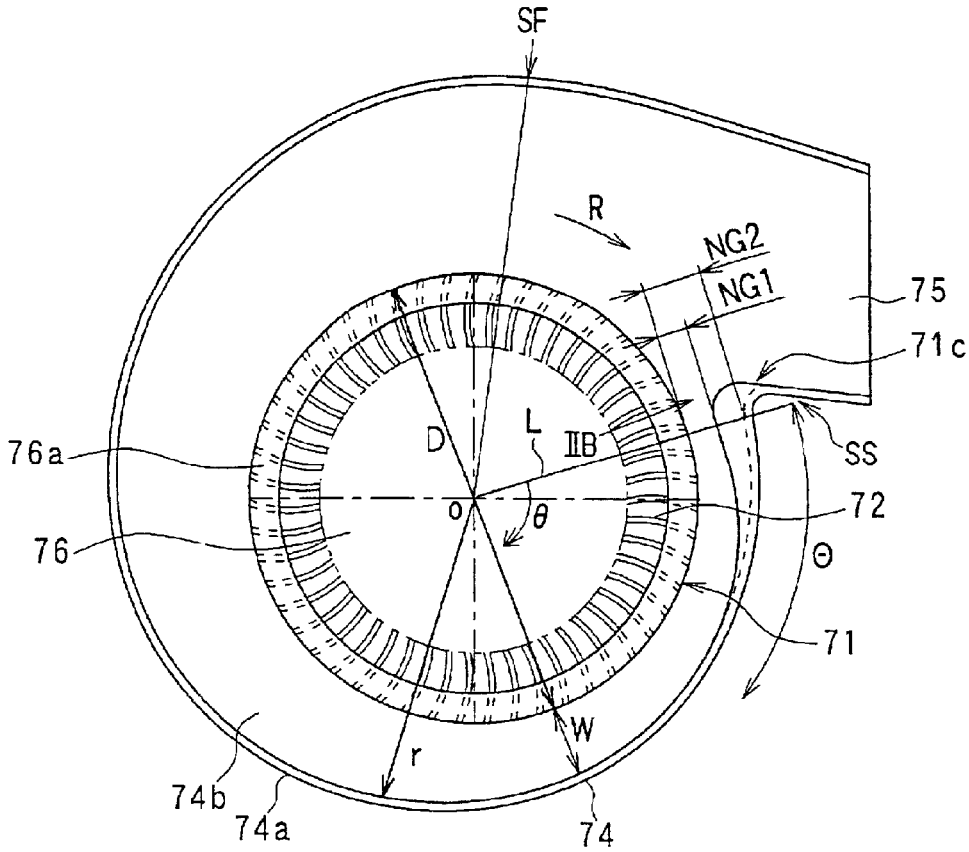
FIG. 3A is a top view of the centrifugal blower according to the preferred embodiment.

As shown in FIG. 3A, the scroll casing 74 is formed into a scroll shape, and the fan 71 is disposed in the scroll casing 74 at a scroll center portion. The scroll casing 74 has a scroll side plate 74*a* constructing an outer wall, and the scroll casing 74 is formed so that a scroll radius "r" from the scroll side plate 74*a* to the rotation axis 7*a* (i.e., rotation center of the fan 71) becomes larger from a scroll start portion (SS) toward a scroll finish portion (SF).

In this embodiment, the scroll radius "r" is changed in accordance with the following formula of $r=ro\cdot\exp(\theta\cdot\tan(n))$. Here, "ro" is the scroll radius on a standard line L at the side of the suction port 76, θ is a scroll angle from the standard line, and "n" is an expansion angle (spiral function).

The scroll casing 74 has therein an air passage 74*b* through which air blown from the fan 71 is introduced into an outlet 75 provided at a scroll finish side. The passage section area of the air passage 74*b* in the scroll casing 74 is enlarged from a scroll start portion SS toward the scroll finish portion SF. A bell-mouth portion 76*a* is provided on an outer peripheral side of the suction port 76 so that air sucked from the suction port 76 is smoothly introduced into the fan 71 along the bell-mouth portion 76*a*.

In FIG. 3A, a dimension between an outer periphery of the fan 71 and an inner wall surface of the scroll side plate 74*a* is defined as an air passage width W (width dimension). Among the air passage width W, the dimension on the side of the suction port 76 is defined as a first clearance dimension NG1 and the dimension on the side opposite to the suction port 76 is defined as a second clearance dimension NG2 in a predetermined inflection range Θ. The inflection range Θ is a predetermined range from the nose portion 71*c* of the casing 74 toward the scroll finish portion SF of the scroll casing 74. In the present embodiment, the first clearance dimension NG1 is set smaller than the second clearance dimension NG2, in the inflection range Θ. Further, a scroll angle θ is an angle from a standard line L to a rotation position of the fan 71 in the rotation direction R.

In the present embodiment, the scroll angle θ of the scroll casing 74 is continuously increased, so that the first clearance dimension NG1 becomes equal to the second clearance dimension NG2 in a range of the scroll angle θ between 20 degrees and 135 degrees.

Figure 3B:
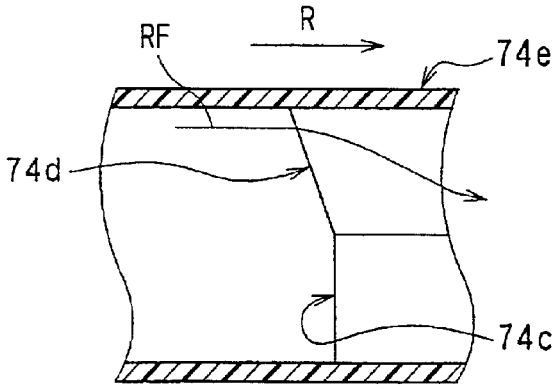
FIG. 3B is a side view when being viewed from arrow IIB in FIG. 3A.

In addition, in the present embodiment, as shown in FIG. 3B, in a wall portion of the scroll casing 74 near the nose portion 71*c*, a first wall part 74*d* on the side of the suction port 76 protrudes from a second wall part 74*c* on the side opposite to the suction port 76 toward a reverse side with the rotation direction R of the fan 71. That is, the first wall part 74*d* protrudes from the second wall part 74*c* toward the air outlet 75 (scroll finish portion). In the vicinity of the nose portion 71*c*, an end portion of the scroll casing 74, opposite to the rotation direction R is tilted from the side of the suction port 76 to the opposite side of the suction port 76 toward the rotation direction, relative to a direction parallel to the rotation axis 7*a*.

According to the present embodiment, the first clearance dimension NG1 is set smaller than the second clearance dimension NG2 only in the inflection range Θ. Therefore, it can reduce the size of the scroll casing 74 while the specific noise and the NZ noise are reduced, as compared with a case where the first clearance dimension NG1 is set smaller than the second clearance dimension NG2 over an entire area from the scroll start portion SS to the scroll finish portion SF.

According to the present embodiment, as shown in FIG. 3B, in the vicinity of the nose portion 71*c*, the first wall part 74*d* on the side of the suction port 76 protrudes toward the reverse side of the rotation direction R of the fan 71, more than the second wall part 74*c* on the side opposite to the suction port 76. That is, the first wall part 74*d* on the side of the suction port 76 protrudes toward the side of the outlet 75 (scroll finish side), more than the second wall part 74*c* on the side opposite to the suction port 76. Therefore, a re-circulation air flow from the scroll finish side toward the suction port 76 can be introduced to the side opposite to the suction port 76 along the first and second wall parts 74*d*, 74*c*. Accordingly, air is blown by the fan 71 toward the downstream air-blowing side, while the re-circulation air does not reversely flow between the blades 72. Thus, an interference between suction air from the suction port 76 and the re-circulation air can be restricted, and low-frequency noise can be sufficiently reduced.

Figure 5A:
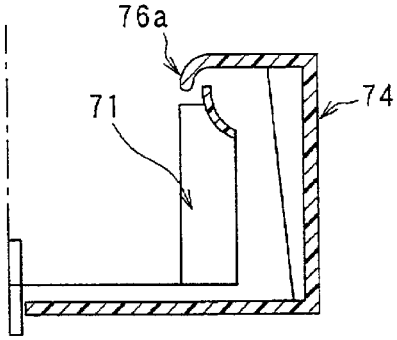
FIGS. 5A and 5B are sectional views each showing a part of a centrifugal blower according to a modification of the preferred embodiment.
Figure 5B:
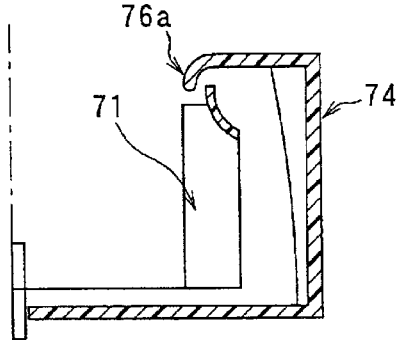

In the blower 7 of the present embodiment, the shape of the air passage width W in the inflection range Θ can be changed as shown in FIGS. 5A and 5B, for example. That is, in FIG. 5A, the air passage width W is continuously changed in a straight line over an entire range from the side of the suction port 76 to the side of the motor 73. Alternatively, in FIG. 5B, the air passage width W is continuously changed in a curved line over an entire range from the side of the suction port 76 to the side of the motor 73.

Figure 6A:
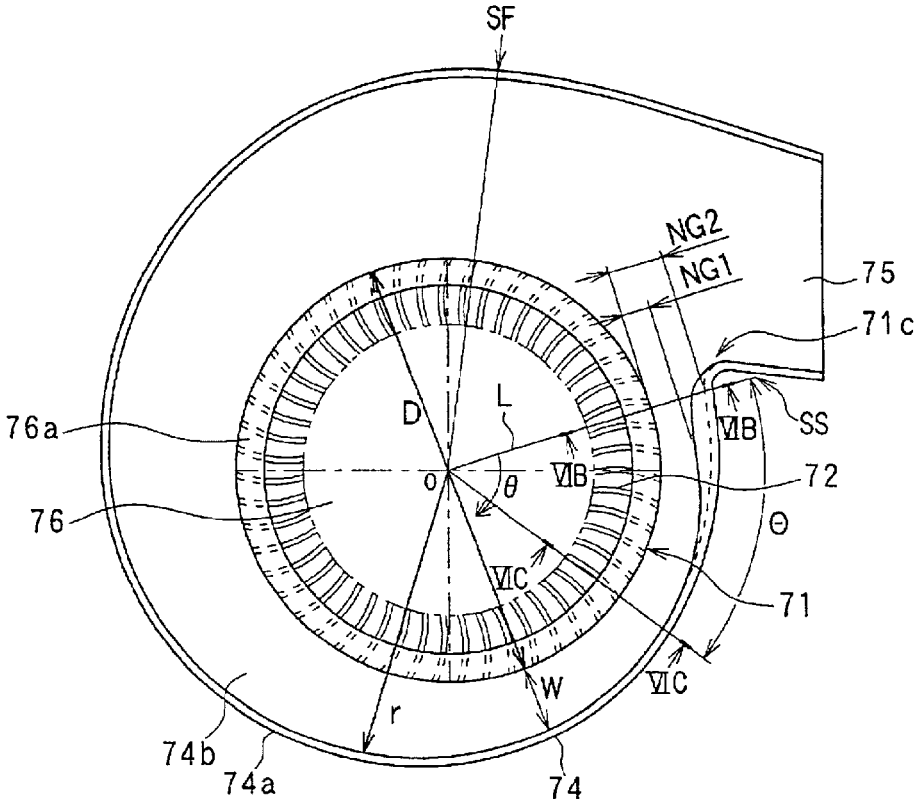
FIG. 6A is a top view of a centrifugal blower of a comparison example.
Figure 6B:
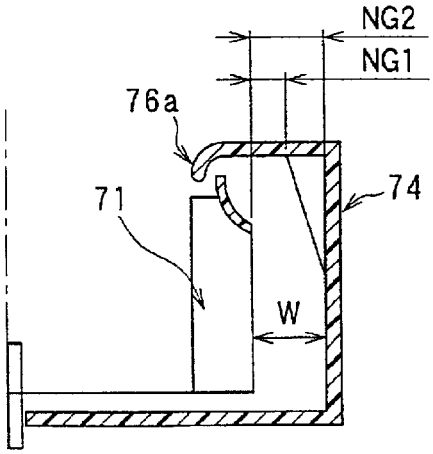
FIG. 6B is a cross-section view taken along line VIB—VIB in FIG. 6A.
Figure 6C:
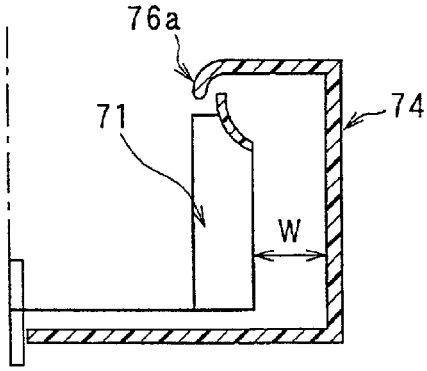
FIG. 6C is a cross-section view taken along line VIC—VIC in FIG. 6A.

FIGS. 6A–6C show a centrifugal blower of a comparison example where the first wall part 74*d* and the second wall part 74*c* shown in FIG. 3B defined in the above-described embodiment are not provided. In FIGS. 6A–6C, the other parts are similar to those in the blower 7 shown in FIGS. 3A and 3B.

According to experiments by the inventors of the present invention, when the first wall part 74*d* is provided relative to the second wall part 74*c* as shown in FIG. 3B, the low-frequency noise can be greatly reduced, as compared with the comparison example shown in FIGS. 6A–6C.

Figure 4A:
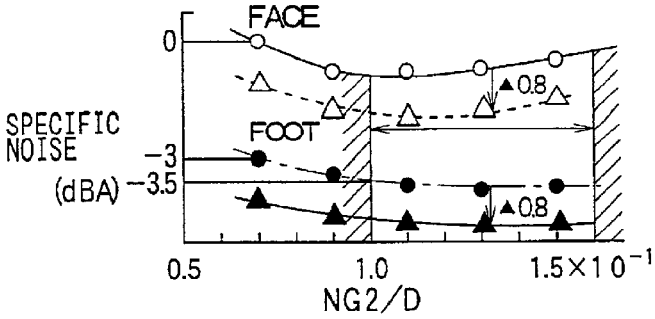
FIG. 4A is a graph showing a relationship between a specific noise level and a second clearance dimension NG2, and FIG. 4B a graph showing a relationship between a low-frequency noise level and the second clearance dimension NG2, according to the preferred embodiment.
Figure 4B:
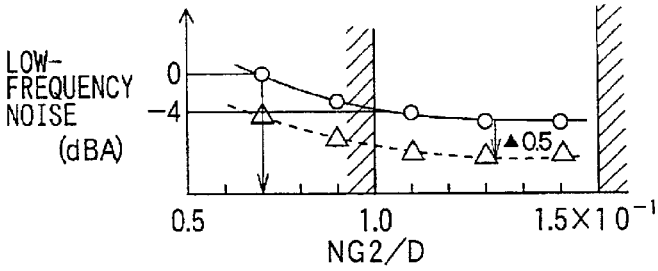

In FIGS. 4A, 4B, the graph indicated by the solid line shows the result in the centrifugal blower of the comparison example, and the graph indicated by the chain line shows the result in the centrifugal blower 7 of the present embodiment. Further, FIG. 4A shows the relationship between the specific noise level and the second clearance dimension NG2, in a face mode (FACE) where conditioned air is blown toward the upper side of the passenger in the passenger compartment and in a foot mode (FOOT) where conditioned air is blown toward the lower side of the passenger in the passenger compartment. Here, D indicates an outer diameter of the fan 71. As shown in FIGS. 4A and 4B, in the blower 7 of the present embodiment, the specific noise can be reduced in the face mode, and the low-frequency noise can be reduced.

Figure 7A:
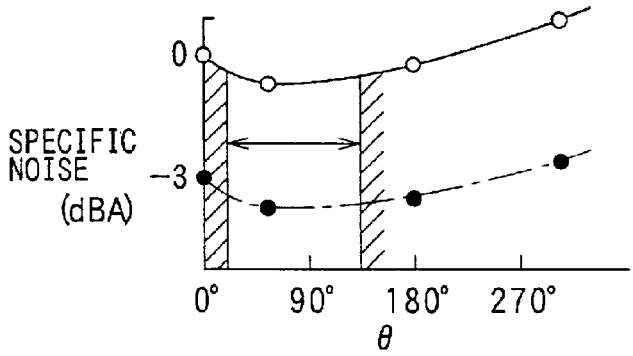
FIG. 7A is a graph showing a relationship between the specific noise level and a scroll angle (θ)
Figure 7B:
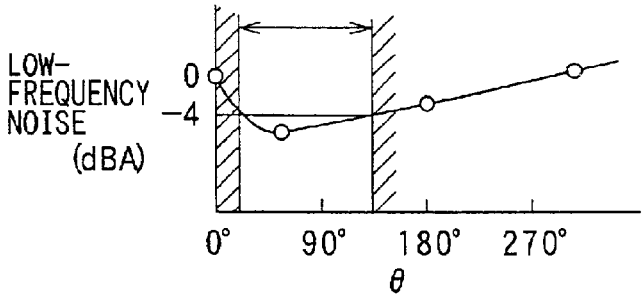
FIG. 7B is a graph showing a relationship between the low-frequency noise level and the scroll angle (θ)
Figure 7C:
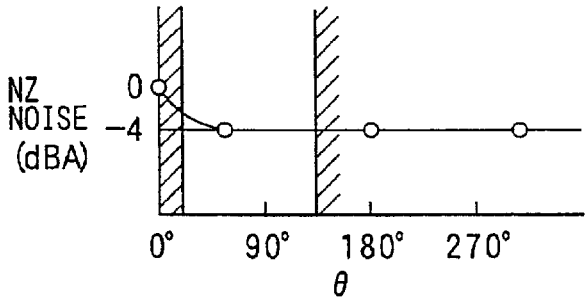
FIG. 7C is a graph showing a relationship between the NZ noise level and the scroll angle (θ)
Figure 8A:
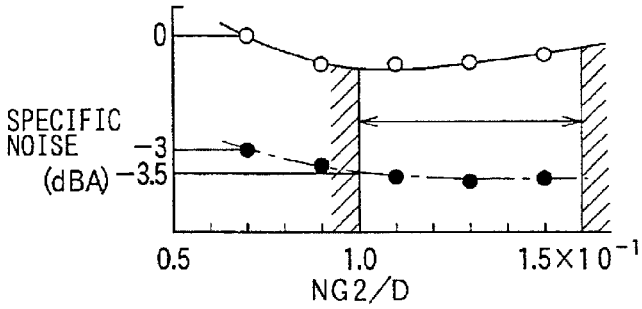
FIG. 8A is a graph showing a relationship between the specific noise level and the second clearance dimension NG2.
Figure 8B:
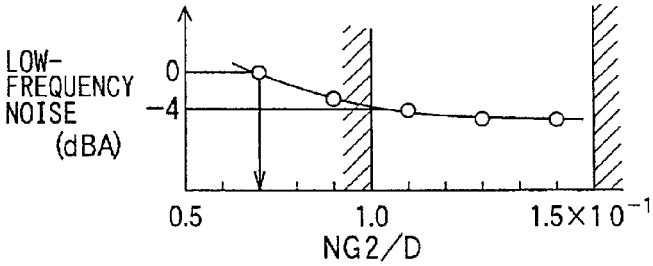
FIG. 8B is a graph showing a relationship between the low-frequency noise level and the second clearance dimension NG2.
Figure 8C:
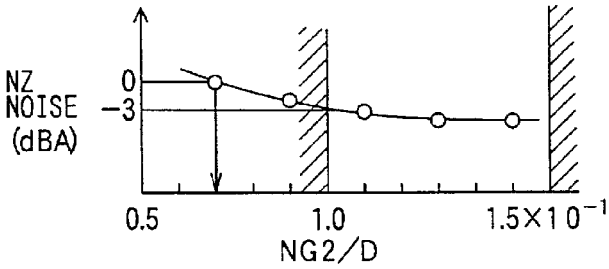
FIG. 8C is a graph showing a relationship between the NZ noise level and the second clearance dimension NG2.

In addition, the inventors of the present invention studied the relationship between noise and the scroll angle θ at the finish of the inflection range Θ as shown in FIGS. 7A–7C, and the relationship between noise and the second clearance dimension NG2. Here, the low-frequency noise is the noise in a low-frequency of 100 Hz–300 Hz. As shown in FIGS. 7A–7C, when the scroll angle θ at the finish of the inflection range Θ is set in a range of 20°–135°, each noise level can be sufficiently restricted. Further, as shown in FIGS. 8A–8C, when the ratio (NG2/D) of the second clearance dimension NG2 to the outer diameter D of the fan 71 is set in a range of 0.1–0.16, each noise level can be sufficiently reduced.

In the above-described experiments, a ratio of the outer diameter D of the fan 71 to the height "h" of the fan 71 is set at 180/70, and the extension angle "n" is set at 5.5°.

Although the present invention has been fully described in connection with the preferred embodiment thereof with reference to the accompanying drawings, it is to be noted that various changes and modifications will become apparent to those skilled in the art.

For example, in the above-described embodiment, the above-described noise-reduction structure is provided in the centrifugal blower 7. However, when the first and second wall parts 74*d*, 74*c* are provided in a blower, the other parts of the blower can be suitably changed. Further, the shape of the first wall part 74*d* and the second wall part 74*c* can be suitably changed, while an end of the scroll casing 74 opposite to the rotation direction R around the nose portion 71*c*, is tilted relative to the line parallel to the rotation axis 7*a* from the side of the suction port 76 to the side opposite to the suction port toward the rotation direction.

Further, the blower of the present invention can be used for the other apparatus such as a ventilation fan.

Such changes and modifications are to be understood as being within the scope of the present invention as defined by the appended claims.

What is claimed is:

1. A centrifugal blower comprising:

a centrifugal fan having a plurality of blades around a rotation axis;

a scroll casing accommodating the centrifugal fan, the scroll casing having a suction port at one end side of the rotation axis, from which air is sucked, wherein:

the scroll casing is formed into a scroll shape having a scroll start side, a scroll finish side, and a nose portion;

the centrifugal fan is disposed in the scroll casing to have a space between the centrifugal fan and the scroll casing at the nose portion, through which the scroll start side and the scroll finish side communicate with each other;

the scroll case has an end in the vicinity of the nose portion, located in a direction opposite to a rotation direction of the centrifugal fan;

the end is tilted relative to a direction parallel to the rotation axis, toward the rotation direction, from a side of the suction port to a side that is opposite to the suction port in a direction of the rotation axis;

the centrifugal fan is disposed in the scroll casing n such a manner that an outer periphery of the centrifugal fan is separated from an inner wall of the scroll casing by a dimension; and in a predetermined range from the nose portion in the rotation direction, the dimension includes a first clearance dimension on the side of the suction port, and a second clearance dimension on the side that is opposite to the suction port in the direction of the rotation axis, the second clearance dimension being larger than the first clearance dimension.

2. The centrifugal blower according to claim 1, wherein:

in the predetermined range from the nose portion in the rotation direction, the dimension becomes larger from the side of the suction port to the side that is opposite to the suction port in the direction of the rotation axis.

3. The centrifugal blower according to claim 1, wherein:

the scroll casing is formed into the scroll shape to have a scroll angle; and the first clearance dimension is equal to the second clearance dimension in a range of the scroll angle between 20 degrees and 135 degrees.

4. A centrifugal blower comprising:

a centrifugal fan having a plurality of blades around a rotation axis;

a scroll casing accommodating the centrifugal fan, the scroll casing having a suction port at one end side of the rotation axis, from which air is sucked, wherein:

the scroll casing is formed into a scroll shape having a scroll start side, a scroll finish side, and a nose portion;

the centrifugal fan is disposed in the scroll casing to have a space between the centrifugal fan and the scroll casing at the nose portion, through which the scroll start side and the scroll finish side communicate with each other;

the scroll case has an end in the vicinity of the nose portion, located in a direction opposite to a rotation direction of the centrifugal fan; and the end is tilted relative to a direction parallel to the rotation axis, toward the rotation direction, from a side of the suction port to a side opposite to the suction port; wherein:

the centrifugal fan is disposed in the scroll casing to have a first clearance dimension between an outer periphery of the centrifugal fan and an inner wall of the scroll casing on the side of the suction port, and a second clearance dimension between the outer periphery of the centrifugal fan and the inner wall of the scroll casing on the side opposite to the suction port; and in the nose portion, a ratio of the second clearance dimension to an outer diameter of the centrifugal fan is in a range of 0.1–0.16.

5. A centrifugal blower comprising:

a centrifugal fan having a plurality of blades around a rotation axis;

a scroll casing accommodating the centrifugal fan, the scroll casing having a suction port at one end side of the rotation axis, from which air is sucked, wherein:

the scroll casing is formed into a scroll shape having a scroll start side, a scroll finish side, and a nose portion;

the centrifugal fan is disposed in the scroll casing to have a space between the centrifugal fan and the scroll casing at the nose portion, through which the scroll start side and the scroll finish side communicate with each other;

the scroll case has a first wall part on a side of the suction port, and a second wall part on a side opposite to the suction port, in the vicinity of the nose portion; and the first wall part is disposed to protrude from the second wall part toward an opposite direction relative to the rotation direction of the fan; wherein:

the centrifugal fan is disposed in the scroll casing to have a first clearance dimension between an outer periphery of the centrifugal fan and an inner wall of the scroll casing on the side of the suction port, and a second clearance dimension between the outer periphery of the centrifugal fan and the inner wall of the scroll casing on the side opposite to the suction port; and in the nose portion, a ratio of the second clearance dimension to an outer diameter of the centrifugal fan is in a range of 0.1–0.16.

6. A centrifugal blower comprising:

a centrifugal fan having a plurality of blades disposed around a rotation axis;

a scroll casing accommodating the centrifugal fan, the scroll casing having a suction port at one side of the rotation axis wherein:

the scroll casing is formed into a scroll shape having a scroll start side, a scroll finish side and a nose portion;

the centrifugal fan is disposed in the scroll casing to have a space between the centrifugal fan and the scroll casing at the nose portion, the scroll start side communicating with the scroll finish side through the space;

the scroll casing has a first wall part on a side of the suction port and a second wall part on a side that is opposite to the suction port in the direction of the rotation axis in the vicinity of the nose portion;

the first wall part protrudes from the second wall part toward a direction opposite to the rotation of the centrifugal fan, the first wall continuously decreases in length from the nose portion to a position spaced from the nose portion in the direction of rotation of the centrifugal fan;

the centrifugal fan is disposed in the scroll casing in such a manner that an outer periphery of the centrifugal fan is separated from an inner wall of the scroll casing by a dimension; and in a predetermined range from the nose portion in the direction of rotation of the centrifugal fan, the dimension includes a first clearance dimension on the side of the suction port and a second clearance dimension on a side that is opposite to the suction port in the direction of rotation axis, the second clearance dimension being larger than the second clearance dimension.

* * * * *